US006062396A

United States Patent [19]

Eason

[11] Patent Number: 6,062,396

[45] Date of Patent: May 16, 2000

[54] INTEGRATED VEHICLE DISPLAY SYSTEM

[75] Inventor: Donald H. Eason, Fort Collins, Colo.

[73] Assignee: Ultimate Support Systems, Inc., Fort Collins, Colo.

[21] Appl. No.: 08/711,164

[22] Filed: Sep. 9, 1996

Related U.S. Application Data

[63] Continuation-in-part of application No. 08/696,258, Aug. 13, 1996, abandoned, which is a continuation-in-part of application No. 29/044,680, Sep. 29, 1995, Pat. No. Des. 372,691.

[51] Int. Cl.[7] ..... A47F 7/00

[52] U.S. Cl. ..... 211/20

[58] Field of Search ..... 211/17, 20, 21, 211/22, 23, 24; D12/115; 70/235; 403/150, 154, 157, 300, 306

[56] References Cited

U.S. PATENT DOCUMENTS

| | | | |
|---|---|---|---|
| D. 260,248 | 8/1981 | Gallagher | D12/115 |
| D. 298,524 | 11/1988 | DeLuca | D12/115 |
| D. 311,884 | 11/1990 | Kagayama | D12/115 |
| D. 330,695 | 11/1992 | Simmons | D12/115 |
| D. 353,353 | 12/1994 | Katsaros | D12/115 |
| D. 372,889 | 8/1996 | Fox | D12/115 |
| 446,835 | 2/1891 | Kennedy . | |
| 506,675 | 10/1893 | Devore . | |
| 511,367 | 12/1893 | Slater . | |
| 556,806 | 3/1896 | Chandler . | |
| 574,629 | 1/1897 | Phillips . | |
| 576,351 | 2/1897 | Penfield . | |
| 595,891 | 12/1897 | Robertson . | |
| 731,651 | 6/1903 | Allen . | |
| 1,932,074 | 10/1933 | Johnson, Jr. | 287/108 |
| 2,567,554 | 2/1951 | Davey | 33/107 |
| 3,116,836 | 1/1964 | McCauley | 211/21 |
| 3,125,341 | 3/1964 | Carrington | 272/73 |
| 3,530,548 | 9/1970 | Gearin | 24/123 |
| 3,603,459 | 9/1971 | Erb | 211/20 |
| 3,762,569 | 10/1973 | Spring | 211/5 |
| 3,785,500 | 1/1974 | Kennelly | 211/5 |
| 3,785,517 | 1/1974 | Brajkovich | 214/450 |
| 3,883,002 | 5/1975 | Moore | 211/18 |
| 3,907,114 | 9/1975 | Ewers | 211/20 |
| 3,941,406 | 3/1976 | Eggleston | 280/400 |
| 3,950,941 | 4/1976 | Ohrn | 59/93 |
| 4,015,718 | 4/1977 | Bernard | 70/235 |
| 4,033,459 | 7/1977 | Zach | 211/20 |

(List continued on next page.)

OTHER PUBLICATIONS

Lindcraft Bycycle Display Fixtures, Wall Mounted Racks, Price List, Published May, 1995.

Yakima, Product Index, Published Sep., 1995.

Rakk Integrated Bike Display System, Ultimate Support Bicycle Support, Brochure, Published Sep., 1995.

*Primary Examiner*—Alvin C. Chin-Shue

*Assistant Examiner*—Sarah Purol

*Attorney, Agent, or Firm*—Santangelo Law Offices P.C.; William F. Vobach

[57] ABSTRACT

A system for conveniently storing a wheel, tire or similar object. The invention allows a user to easily insert such an object into a support stand and establish a three point support of the object. Furthermore, the system has an actuation feature that allows a support stand to be easily and compactly configured for storage and shipment. The system uses a rotating support surface to establish contact with a wheel, tire or other similar object. In this fashion, a normal force can be exerted against the object while the support surface is free to turn. This allows an object with a rough surface area to be positioned by the force while not allowing the rough surface area to effect such positioning. A mechanism accommodates tires of different sizes, thereby allowing tires to be positioned on support settings unique to each sized tire. A self adjusting feature allows the movement arm to move in response to the tire size, thereby establishing the appropriate settings. A rotating support is disclosed that provides greater flexibility to a support stand in interfacing with tires of rough surface areas by preventing those surface areas from interfering with the support establishment process.

11 Claims, 16 Drawing Sheets

U.S. PATENT DOCUMENTS

| | | | |
|---|---|---|---|
| 4,126,228 | 11/1978 | Bala et al. | 211/5 |
| 4,352,432 | 10/1982 | Smith | 211/19 |
| 4,371,082 | 2/1983 | Hostert | 211/22 |
| 4,629,104 | 12/1986 | Jacquet | 224/324 |
| 4,662,617 | 5/1987 | Ditterline, Jr. et al. | 269/16 |
| 4,802,594 | 2/1989 | Graber | 211/20 |
| 4,830,167 | 5/1989 | Lassche | 194/247 |
| 4,842,148 | 6/1989 | Bowman | 211/18 |
| 5,036,986 | 8/1991 | Kral | 211/22 |
| 5,078,277 | 1/1992 | Tschritter | 211/20 |
| 5,169,044 | 12/1992 | Englander | 224/324 |
| 5,186,569 | 2/1993 | Wu | 403/154 |
| 5,188,479 | 2/1993 | Nehls | 403/306 |
| 5,246,120 | 9/1993 | Walker | 211/19 |
| 5,267,657 | 12/1993 | McGuiness et al. | 211/22 |
| 5,297,888 | 3/1994 | Nehls | 403/306 |
| 5,301,817 | 4/1994 | Merritt | 211/5 |
| 5,320,227 | 6/1994 | Minoura | 211/22 |
| 5,385,246 | 1/1995 | Grossnickle | 211/22 |
| 5,417,629 | 5/1995 | Phipps | 482/61 |
| 5,456,367 | 10/1995 | Beukeveld | 211/22 |
| 5,476,203 | 12/1995 | Fletcher | 224/536 |
| 5,498,015 | 3/1996 | Trout et al. | 280/293 |
| 5,501,542 | 3/1996 | Hall, Sr. | 403/306 |
| 5,553,715 | 9/1996 | Brotz | 211/5 |
| 5,560,498 | 10/1996 | Porter | 211/20 |

INTEGRATED VEHICLE DISPLAY SYSTEM

This is a continuation-in-part of application number 08/696258, filed on Aug. 13, 1996, now abandoned, which is a continuation-in-part of application number 29/044,680, filed on Sep. 29, 1995, now U.S. Pat. No. D372,691.

BACKGROUND OF THE INVENTION

This invention relates to the field of support systems for vehicles. Specifically, the invention focuses on devices used for supporting bicycles. Furthermore, the invention relates to the field of displaying bicycles.

Since at least the 1890s, people have been confronted with the problem of how to support a bicycle when the bicycle is not in use. Prior bicycle stands have suffered from numerous problems. Among these are the fact that they often take up a large amount of space, are unwieldy, are difficult to transport, and when used in conjunction with similar bicycle stands, are limited to an alignment which often does not conform to the space limitations of a facility. Furthermore, prior bicycle stands have often utilized an assembly which grasps the bicycle along the bicycle frame, thus creating the possibility of damaging or scratching the bicycle frame and leaving a damaged appearance to the bicycle.

In the past, there have been attempts to support a bicycle purely by supporting the bicycle wheel. These attempts have been unsatisfactory as they have provided an unwieldy support or a support that is difficult to implement because it requires a user to physically lift the bicycle and place the bicycle within the stand. For example, inventors in the past have tried to support a bicycle wheel with a stand where one of the support points consists merely of a sling. As a result, the support provided to the bicycle wheel is unwieldy as the sling allows the bicycle wheel to wobble. This wobbling of the bicycle wheel is unsatisfactory. It allows a bicycle to be easily tipped out of position. This is a serious drawback when such a stand is used in a store for displaying bicycles. It often leads to a domino effect—knocking down an entire row of bicycles. Such a bicycle stand also leaves a negative impression about the bicycle being displayed in the eyes of the consumer. A solid bicycle stand provides a much more positive impression to a consumer inspecting a bicycle. It creates a greater sense of confidence during inspection and allows greater physical contact with the bicycle stand provides a much more positive impression to a consumer inspecting a bicycle. It creates a greater sense of confidence during inspection and allows greater physical contact with the bicycle.

In the past, it has been common to arrange bicycles purely in an axial alignment. This alignment has been in large part due to the fact that most bicycle stores used to operate on a year long basis. However, bicycle stores are now often operated on a seasonal basis. Therefore, it is common for bicycle stores to sell bicycles in the summer and to double as ski stores during the winter—selling skis or other types of merchandise. Therefore, there is a need for a compact bicycle stand that can be collapsed into a space saving configuration when it is not in use during the winter months. This factor applies as well even when the bicycle stand is being used in the bicycle store for displaying bicycles. Display space is a premium; the more compact the bicycle stand can be made, the more bicycles that can be displayed in a given amount of space. However, prior attempts at creating bicycle stands have failed to appreciate this fact and have often resulted in bulky frames which seem to lack any consideration of saving space.

Prior bicycle stands have often been of the type that require lifting the bicycle and depositing it onto the bicycle stand. The aspect of having to lift the bicycle to put it into a stand can be very difficult for a person who does not have the strength to accomplish the lifting of the bicycle. Especially, with the advent of car racks, lifting a bicycle in order to place it in a stand requires significant upper body strength. It is therefore obviously preferred to have a bicycle stand which does not require such lifting.

Prior bicycle stands have often been prefabricated stands that remain in their prefabricated shape during use. This was deemed necessary to provide the support that a heavy vehicle requires. However, creating a bicycle stand of such size not only requires a large amount of space to store the bicycle stand when it is not in use, but it also makes shipment of the bicycle stand more expensive. Furthermore, those stands that have tried to accomplish a configuration for shipment have been unable to successfully provide a stand that can be quickly and easily established in an operation configuration. Also, these prior attempts have been flimsy. For example, some stands have allowed pieces to swing freely without any latching ability to prevent such swinging. This obviously creates a problem for shipment as well as the possibility of damaging the bicycle stand, the user, or other pieces of equipment. Finally, prior bicycle stands have been limited to arrangements that anticipate long axial alignments. However, these prior attempts have not appreciated the fact that non-axial alignments are oftentimes useful. Furthermore, prior attempts have failed to appreciate that a user of a plurality of bicycle stands often would like the flexibility to select a desired arrangement of a group of bicycle stands in order to create a visual effect, to utilize the display space in the most preferred way, or to establish a closed arrangement of the bicycle stand that accomplishes a substantial base support for the bicycles being displayed.

In addition, prior attempts at displaying bicycles have suffered from the drawback that damage can be caused to the spokes of the wheel when inserting the wheel into the bicycle stand. This often is a result of the bicycle wheel not being guided properly to the support position. These prior attempts have failed to appreciate the ability to guide the bicycle wheel, especially guiding the bicycle wheel from the upper portion of the bicycle wheel rather than the lower portion of the bicycle wheel. In addition, prior attempts to provide bicycle support stands utilized stands that took up a large amount of floor space. These prior attempts failed to appreciate the fact that space above the footprint of the stand could be utilized, thus doing away with the need to create a larger footprint for the stand. Finally, the advent of mountain bicycling as well as the advent of specialized bicycles has resulted in a variety of tire shapes and sizes. Therefore, a need has arisen to be able to produce a bicycle stand that is capable of accepting many of these different sizes of tires and tire surfaces. Furthermore, it is necessary to be able to conform to the shape of the bicycle tire or provide a shape similar to the shape of the bicycle tire in order to establish a firm support for the bicycle.

Prior attempts to provide adjustable components as part of the bicycle stand have failed to appreciate the use of actuators to accomplish the physical adjustment of a bicycle stand. Bicycle stands are often located in difficult to reach areas—either close to the ground or on top of vehicles. Therefore, a need exists for a device that adjusts itself rather than requiring the user to make the adjustment. Prior vehicle stands have failed to appreciate this fact.

SUMMARY OF THE INVENTION

Accordingly, the present invention provides an apparatus and methods through which a vehicle wheel or a vehicle, especially a bicycle, can be easily and firmly supported. The invention utilizes a three point support to establish a plane of support for a vehicle wheel. This plane of support yields a firm support so that the vehicle wheel will not wobble and the domino effect will not occur. Furthermore, the invention provides a system for easily positioning the vehicle wheel in a support position. This positioning is easily accomplished by rolling the vehicle wheel into a support stand allowing the vehicle wheel to be guided to a preferred position.

The invention also allows for a variety of tire or wheel sizes to be accommodated. This is accomplished by a movable support system that allows a tire or wheel to be placed in contact with a support and moved to a preferred support position appropriate for that tire or wheel size. This position can vary for tires or wheels of different sizes. Therefore, a firm support can be established by a single stand for tires or wheels of varying sizes (i.e., varying widths and radii).

The invention also entails a system for compactly storing a vehicle support stand by allowing the vehicle support stand to collapse to a compact configuration. This is easily accomplished by an actuator that closes the vehicle support stand quickly and firmly and maintains the vehicle support stand in its compact position. Furthermore, the system allows the vehicle support stand to be latched in an open position as well as a closed position.

The invention utilizes a rotating surface that interfaces with a tire or wheel and facilitates the positioning of a tire or wheel as well as providing support to the tire or wheel. This rotating surface allows a normal force to be exerted against the tire or wheel, yet does not catch on tread surfaces of a tire or wheel. This rotating surface also serves to accommodate tires or wheels of varying sizes. Furthermore, other supports of the support stand accommodate tires or wheels of varying sizes as well.

The invention utilizes a system for positioning a plurality of vehicle supports in relationship to one another while coupling those systems together. This coupling allows further support of the vehicle support. It also permits a flexible arrangement of the vehicle support and therefore allows a user to arrange the supports in a fashion most suitable for the user's floor space. Furthermore, it also allows the user to arrange the supports in attractive displays that appeal to consumers.

Accordingly, it is an object of the invention to provide a system that can be used to support a plurality of bicycles or other vehicles in an arrangement that is not purely an axial or longitudinal arrangement, but rather, can be altered by a user as the user feels is best suited for the user's space. Furthermore, it is an object of the invention to provide a vehicle support that is capable of coupling to other vehicle supports and creating a firmer or more stabilized system of support. It is also an object of the invention to allow this system to be configured in a variety of shapes that are attractive to consumers or that can be configured to a given floor space.

A further object of the invention is to provide a system that can firmly support a tire or wheel; especially a vehicle tire or wheel. One aspect of this goal is to provide such support while not causing damage to the frame or scratching metal surfaces of the vehicle. A further goal is to provide an easy way of positioning the tire or wheel on the support by establishing a normal force against the tire or wheel while still allowing the tire or wheel to rotate.

Yet another object of the invention is to provide a guide for guiding the tire or wheel to the proper position on the support. One aspect of this goal is to provide a support on the upper portion of the tire or wheel thereby not risking damage to linkages or other parts of the vehicle often found, for example, on the lower portion of a bicycle.

A further object of the invention is to accommodate tire or wheel sizes of different width and radius. Not only is it a goal of the invention to accommodate these different sizes on rigid supports but on rotatable supports as well. One aspect of this goal is to provide a support that moves as the tire or wheel is being placed into the support stand and thereby allows for a preferred three point support system to be established. A further goal of the invention is to provide a guide to guide a tire or wheel to a preferred position. One aspect of this goal is to provide a guide and direct contact with the tire or wheel to facilitate this positioning.

A further object of the invention is to provide a support system that will allow easy implementation of such support. For example, it is a goal to allow a tire or wheel to be easily pushed onto a support.

Yet another object of the invention is to provide a stand that is secure in that it will not easily slide when a tire or wheel is pushed against it or other forces are exerted against it. Therefore, one aspect of this goal is to provide a support stand that supplies a frictional surface for resisting such forces.

Yet another object of the invention is to provide a guide that allows tires or wheels with uneven surfaces (e.g., knobby tire surfaces) to be positioned. Furthermore, this goal entails allowing the tire or wheel to be positioned without binding the positioning apparatus. Another aspect is to provide an actuator that maintains the support in contact with the tire or wheel regardless of the force asserted by the tire or wheel against the guide.

An additional object of the invention is to provide a support that accommodates tires or wheels of different characteristics. One aspect of this object is to allow the positioning of a tire or wheel while allowing the tire or wheel itself to rotate about its axis or to pivot about a point while still maintaining engagement with the positioning apparatus. Furthermore, it is an object of the invention to allow the positioning apparatus support to alter its position while still maintaining a normal force against a tire or wheel that is to be positioned. Also, one aspect of this object is to provide a support that is capable of establishing contact or engagement with a variety of tire or wheel sizes, including tires with substantially rough tire or wheel surfaces.

A further object of the invention is to provide a device that is capable of collapsing into a compact configuration. One aspect of this object is to provide a system that is capable of closing the support from its normal operation to a closed position that is utilized for storage or shipment. A further aspect is to provide an actuator to accomplish this. Yet another aspect is to provide a latching system to ensure that the support will be maintained in a closed position when a closed position is desired or maintained in an open position when it is desired to utilize the support system.

Furthermore, it is an object of the invention to establish a stand that does not occupy a significant amount of space.

A further object of the invention is to provide a support stand suitable for use in either a home, store, or as part of a car rack.

A final object of the invention is a system that allows positioning or support of a wheel and that does not catch on the wheel. Such a system can be used not only in the bicycle storage field but also in a wide variety of environments such as manufacturing, assembly lines, and the automotive industry.

DETAILED DESCRIPTION OF THE PREFERRED EMBODIMENTS

Figure 8:
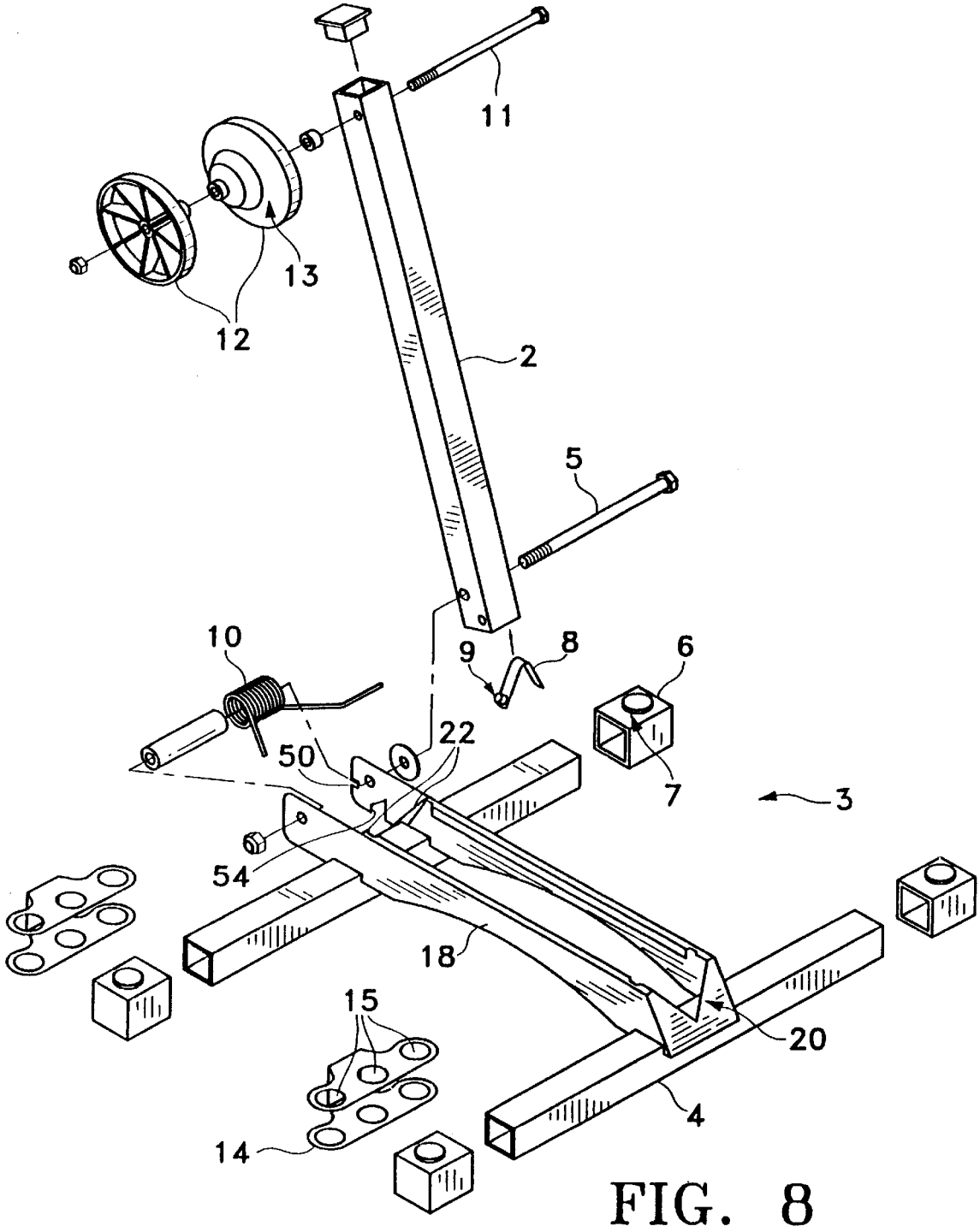
FIG. 8 is an exploded view of the support stand.
Figure 9:
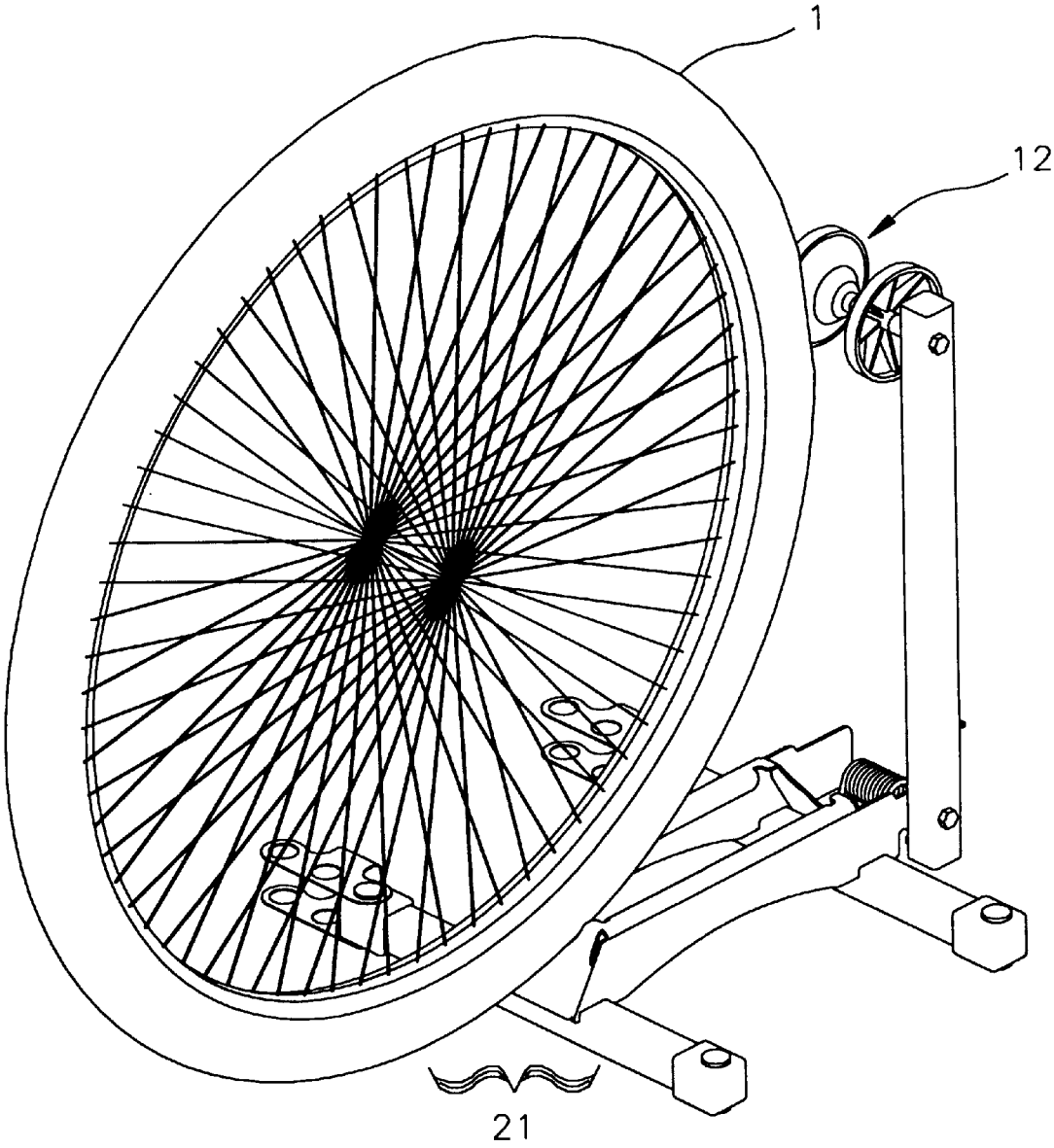
FIG. 9 is a perspective view of the support stand with a tire in contact with a first support.
Figure 10:
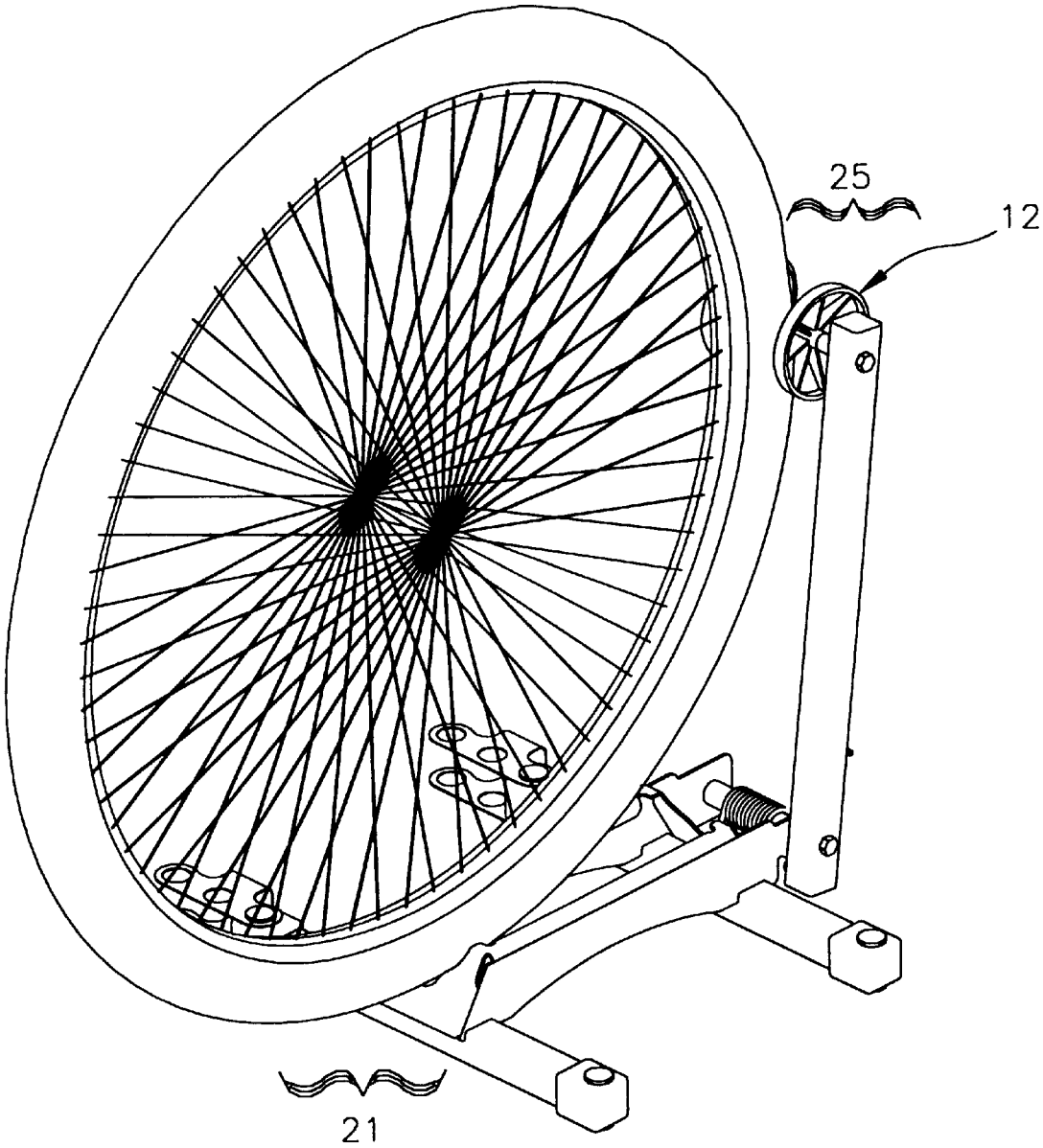
FIG. 10 is a perspective view of the support stand with the tire in two point contact with the support stand.
Figure 11:
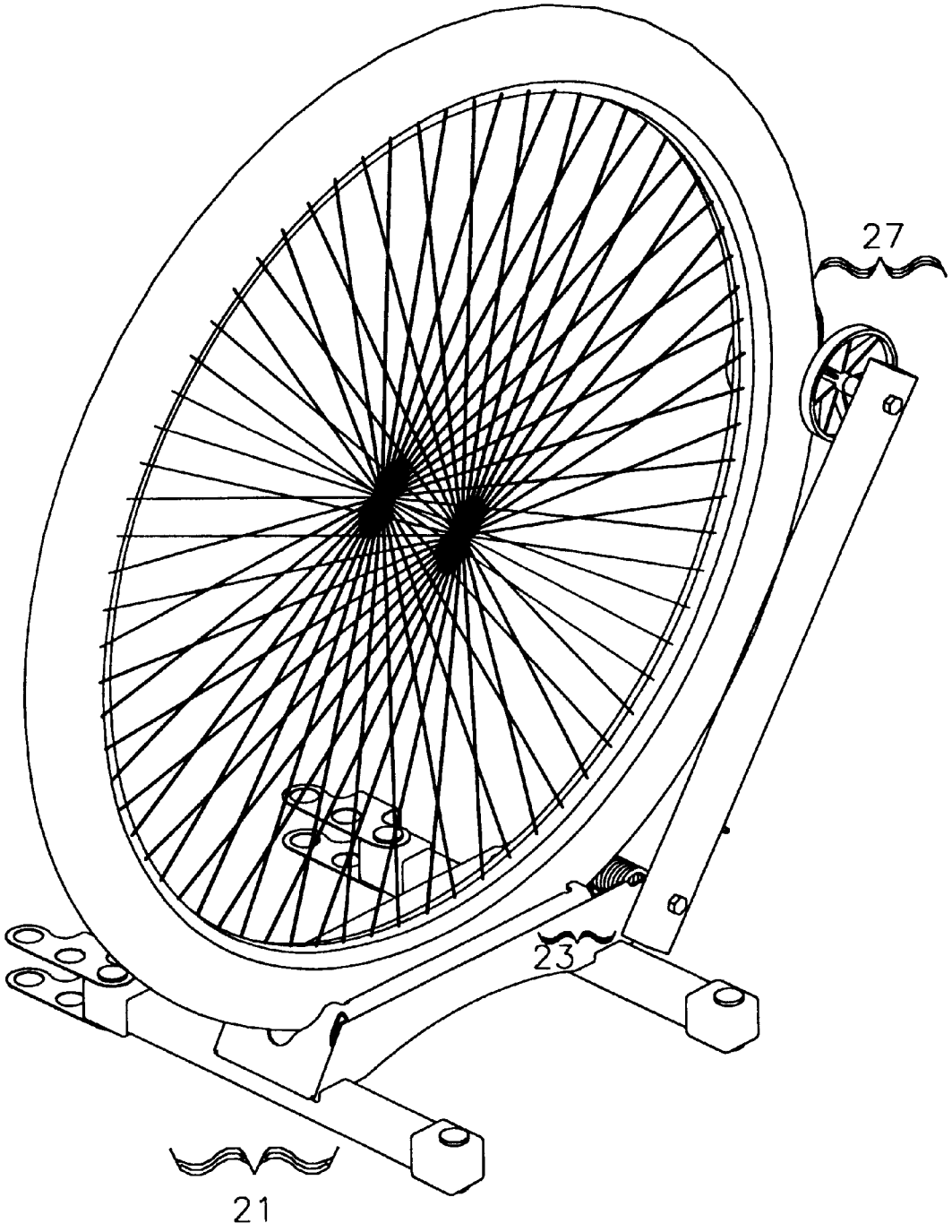
FIG. 11 is a perspective view of the support stand with the tire established in three point contact with the support stand.
Figure 12C:
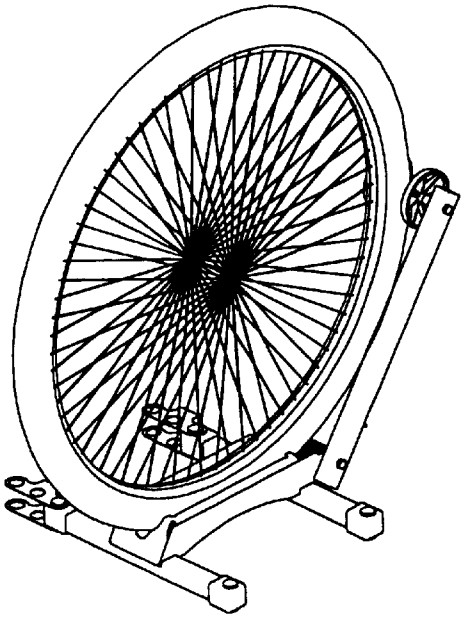
FIGS. 12*a*–12*c* shows the sequence of a tire being positioned onto a support stand.
Figure 12B:
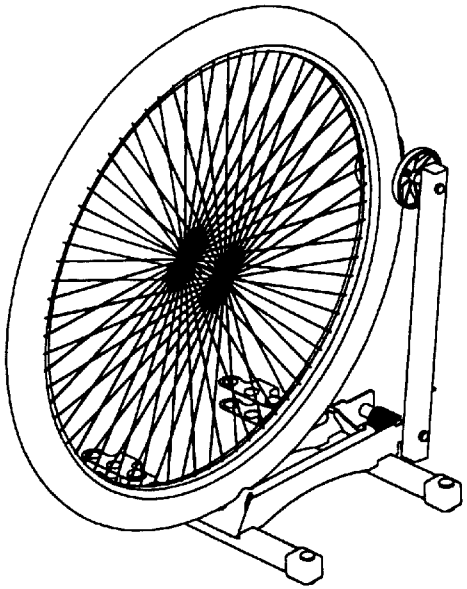
Figure 12A:
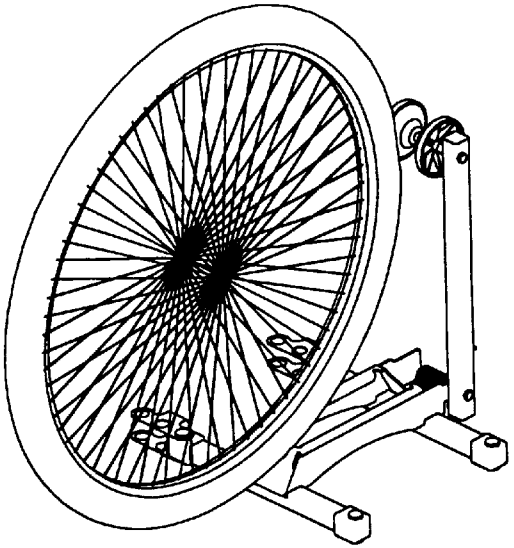
Figure 13A:
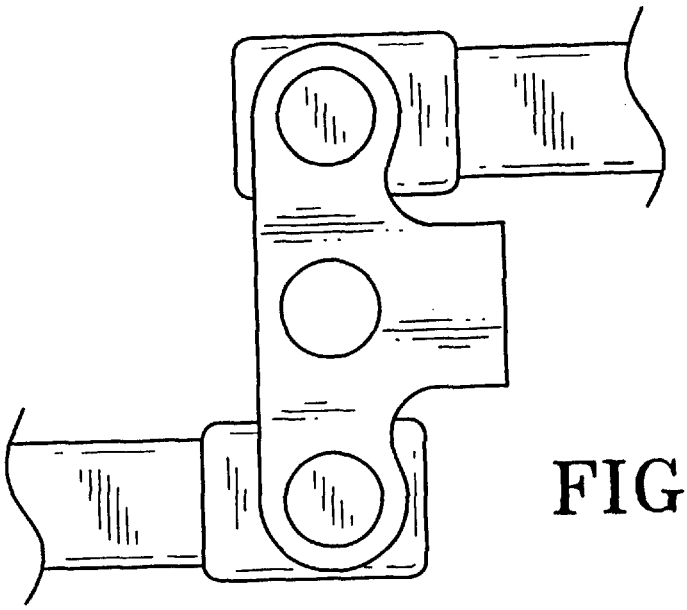
FIG. 13*a* shows a cutaway view of a coupling arrangement where the middle holes of the coupling link are not used.
Figure 13B:
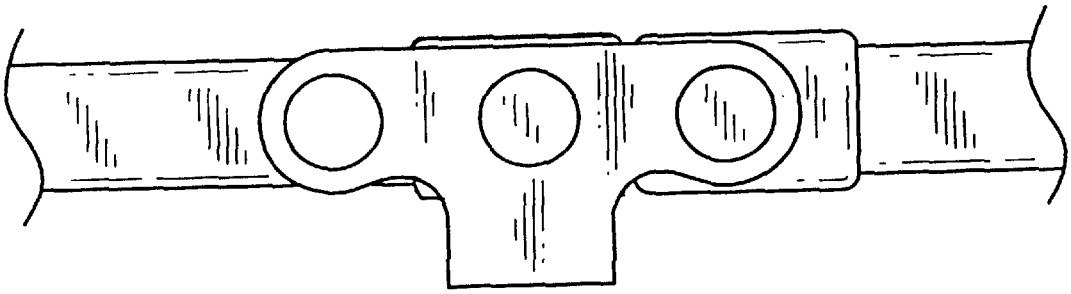
FIG. 13*b* shows a cutaway view of a coupling arrangement where the middle holes and one set of end holes are used to establish a close coupling.
Figure 13C:
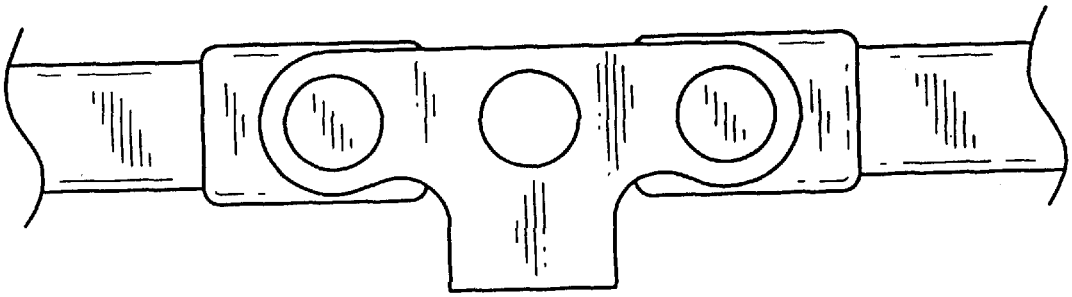
FIG. 13*c* shows a cutaway view of a coupling arrangement where the two sets of holes are used to provide greater distance between two stands.

With reference now to the drawings, and in particular to FIG. 8, a new and improved support stand for vehicles embodying the principles and concepts of the present invention will be described. The invention differs from traditional support stands in significant ways. The basic concepts of the present invention may be embodied in different ways.

Referring to FIG. 8, an exploded view of the invention can be seen. The support stand (3) is comprised of a base unit (4) coupled to a lever arm (2) which in turn is also coupled to a support (12). Furthermore, the support stand (3) utilizes two additional supports, namely, a first support (20) and a second support (22) for supporting a wheel or tire. Lever arm (2) is capable of pivoting about an axis defined by retaining pin (5). Also, support (12) which establishes a third support on a wheel being supported is also capable of at least partially rotating about an axis defined by second retaining pin (11).

Figure 14:
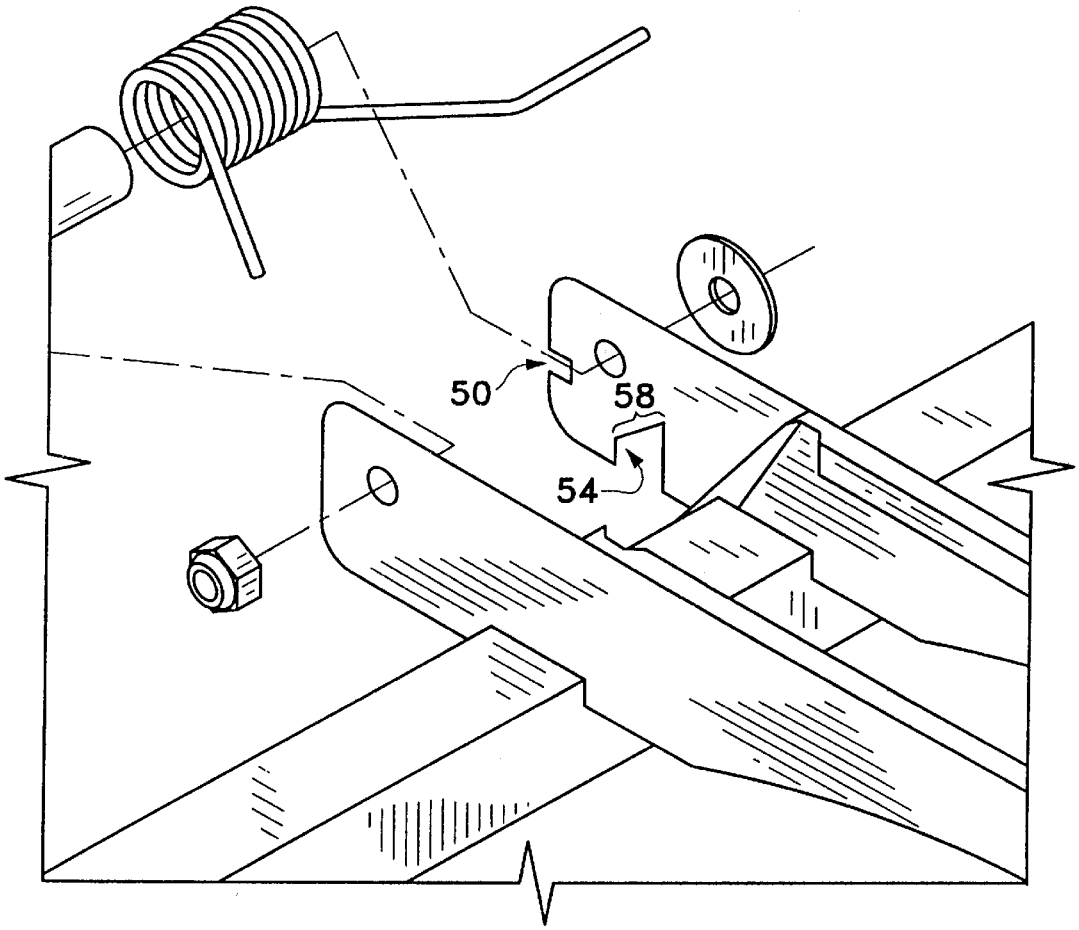
FIG. 14 shows an enlargement of the exploded view in FIG. 8.

A coiled spring (10) is positioned on the base support (4) for exerting a force against lever arm (2). The spring (10) acts as an actuator and tries to force the lever arm about its axis of rotation toward the front of the stand. Lever arm (2) is retained in an open and upright position by button clip (8) which is locked in place as those with ordinary skill in the art would readily understand. Furthermore, as can be seen in FIG. 14, the button clip button can be positioned at open position (54) to retain the lever arm in an open position. Button clip (8) can be depressed to allow lever arm (2) to close to a compact position. Upon achieving its closed position, the button clip (8) again establishes a latching configuration for retaining the lever arm in a closed position. This position of the button clip is shown in FIG. 14 as position (50). Furthermore, spring (10) can maintain a force against lever arm (2) urging the lever arm towards its compact position. Therefore, not only is the lever arm maintained in its compact position by the button clip latch, but also, the spring (10) can be used to maintain that positioning as well.

While low carbon steel is the preferred material from which most of the support stand elements are made, other materials could be used as well. For example, aluminum would serve as a satisfactory material. Low carbon steel is preferable as it is heavier than aluminum and therefore results in a stand that is more difficult to be pushed out of position.

A three point support of a tire (1) placed in the support (3) can be accomplished via first support (20), second support (22), and third support (12). The first support (20) engages a first portion of a vehicle wheel or tire. The second support (22) also engages a portion of the wheel or tire, and the third support (12) engages a third portion of the wheel or tire thereby establishing three points of contact on the wheel or tire. This effectively establishes three firm points of contact on the wheel or tire thereby establishing rigid support of the wheel or tire in a stationary position. While utilization of the third support maintains a force against the wheel or tire, the third support is able to rotate about its axis while providing this support. Therefore, to establish or position the tire or wheel in the support position (i.e., the final resting position of the tire when placed in the stand), the tire or wheel is able to rotate across the first support position and contact the third support before contacting the second support (22). Because the third support (12) is able to rotate, it does not catch on any knobs or uneven surfaces of a tire. This makes the rotating surface of support of this third support (12) very useful as it facilitates positioning of the wheel or tire onto the second support. A non-rotatable support would catch on a knobby tire tread or other uneven surface and prevent a tire from being positioned on the second support. This allows a rigid support to be easily manufactured for the base support (4) and facilitates rigid support of a tire. Because of the ability of the third support to rotate and accomplish the preferred positioning, both the first support (20) and second support (22) can be utilized as simple rigid supports. However, it is envisioned that additional rotatable supports could be used as well.

Figure 1:
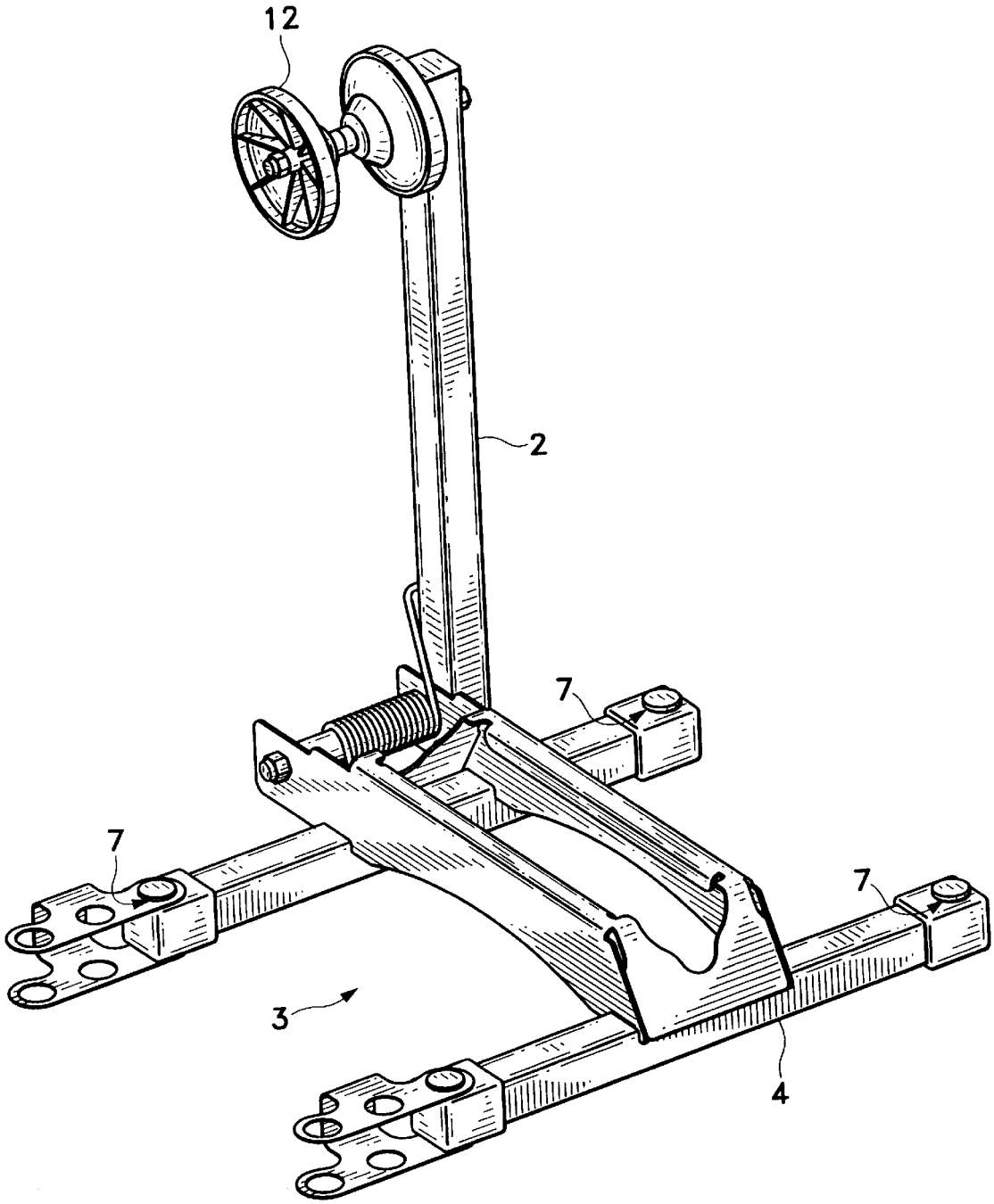
FIG. 1 is a perspective view of a support stand.
Figure 2:
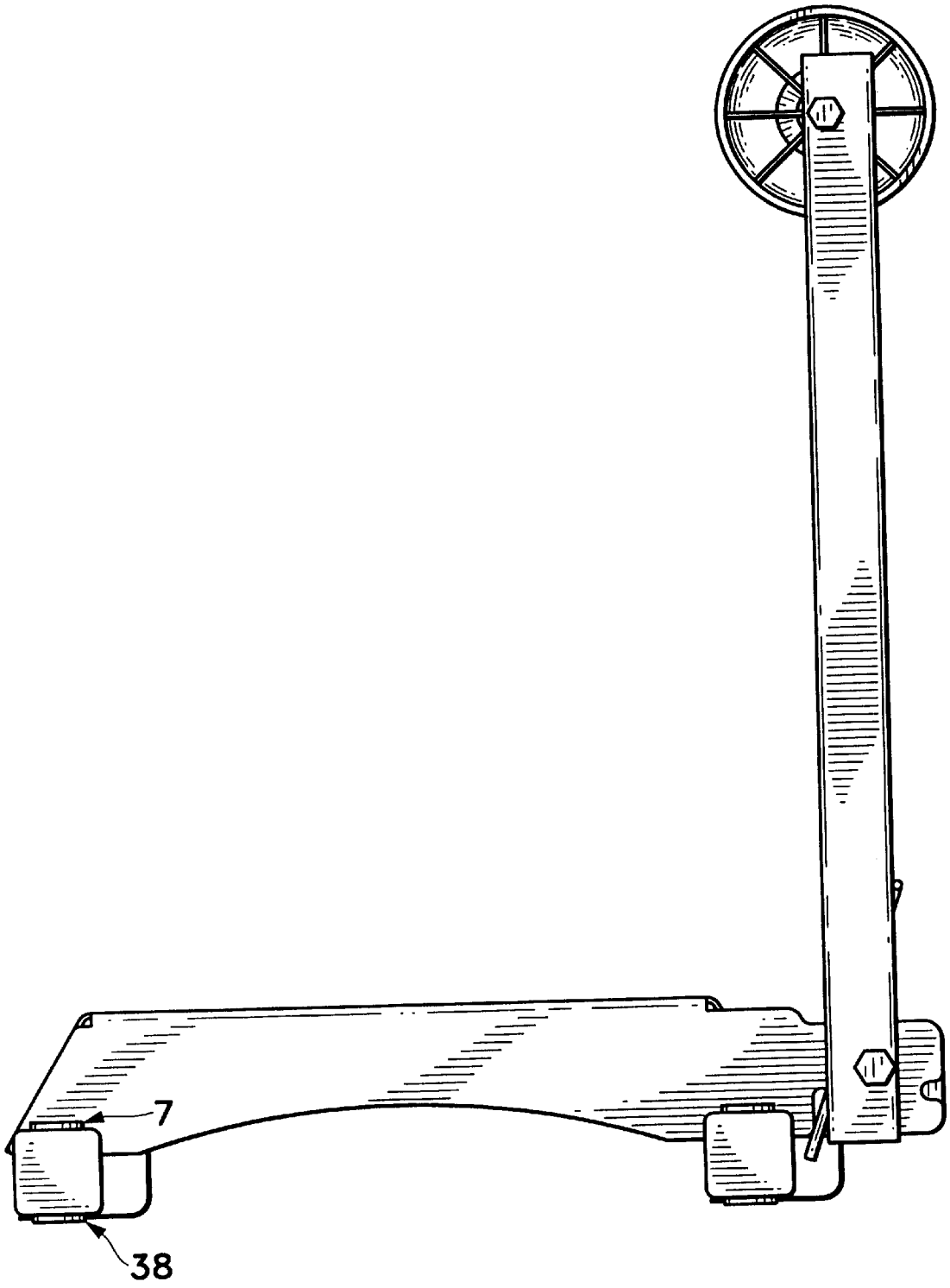
FIG. 2 is a right side elevation view of the support stand in an open position.

As can be seen in FIG. 1, the first rigid support (20) can be shaped or configured to accept or conform to a variety of tire sizes or shapes. This is evident from the shape of first rigid support (20) which resembles intersecting U's. Similarly, the second support (22) can be configured this way as well. As can be seen in FIG. 1, this type of shape can also be configured to accept the generally standardized sizes of tires and to establish firm contact or engagement with such tires. For example, 20", 24", 26", 27", and 700*c* sized tires can be accepted. Further still, the first and second supports can be generalized to accept tires of most any size. As can be seen in FIG. 8, even a V.

To accomplish a rotatable support, a rotatable support surface is configured to at least partially rotate about an axis while retaining engagement with the wheel. As seen in FIG. 8, this rotatable support surface (13) rotates about an axis which is a retaining pin (11) positioned through the lever arm (2). Specifically, two rotating support surfaces are utilized in FIG. 8, one surface is utilized for one half of the third support and a similar configuration is utilized for the second half of the third support. However, a single piece configuration could easily be used as well. The rotatable support surface (13) can be configured to accept a variety of tire shapes and sizes as well. It also can be shaped to accept the standardized tire sizes as well as being configured to establish significant contact with a non-standardized tire or wheel size.

Figure 3:
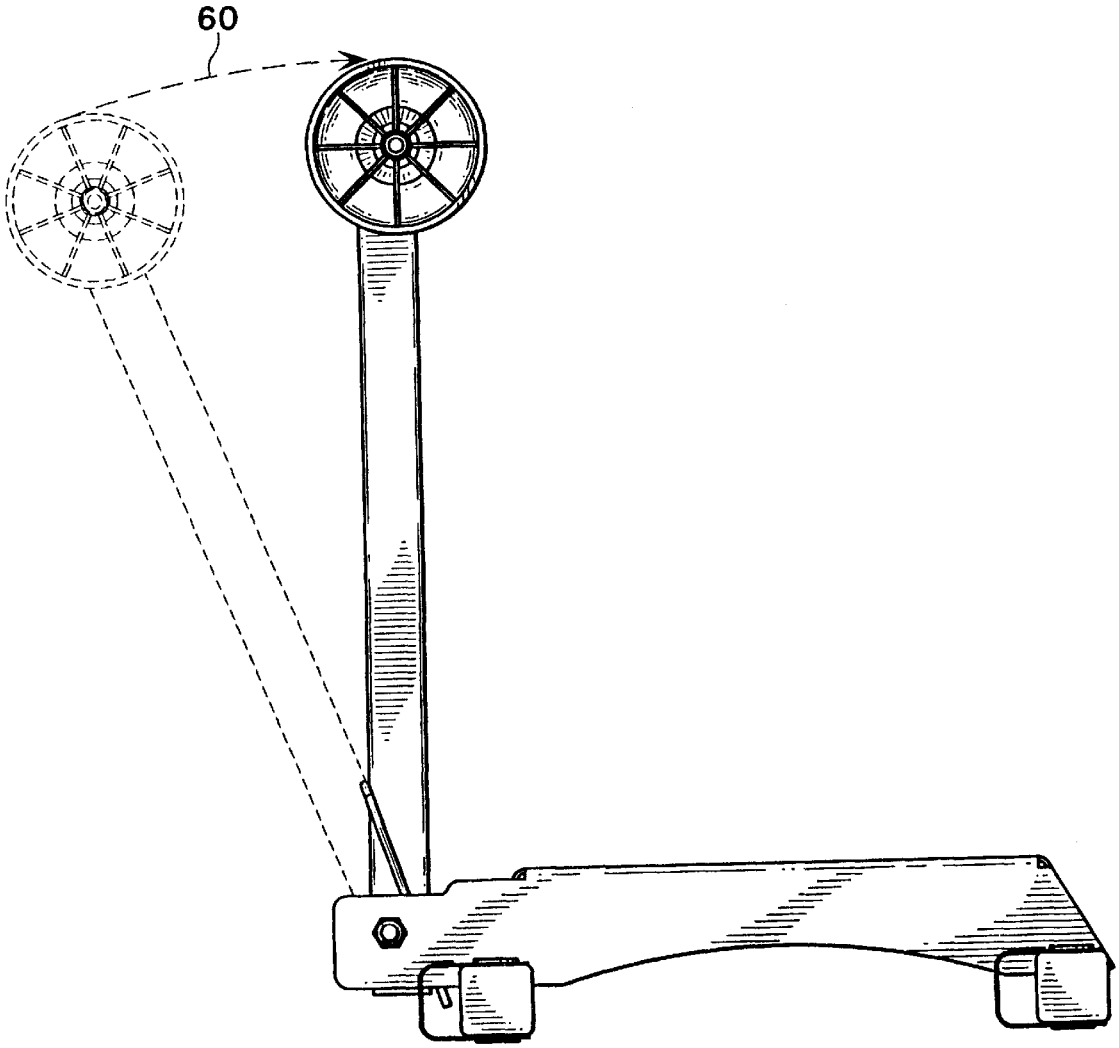
FIG. 3 is a left side elevation view of the support stand in an open position, showing the range of movement ability of the lever arm.
Figure 4:
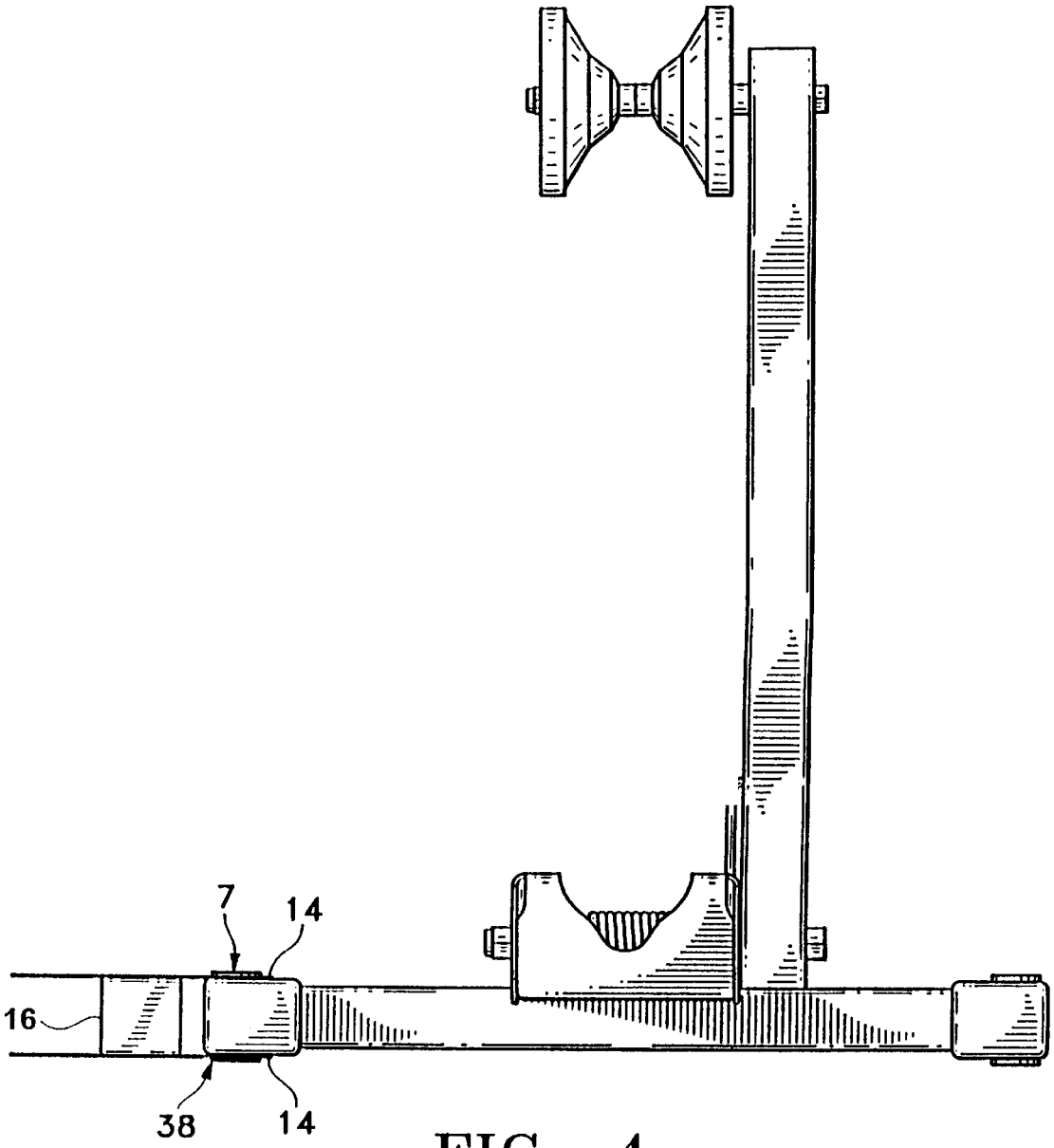
FIG. 4 is a front elevation view of the support stand in an open position.
Figure 5:
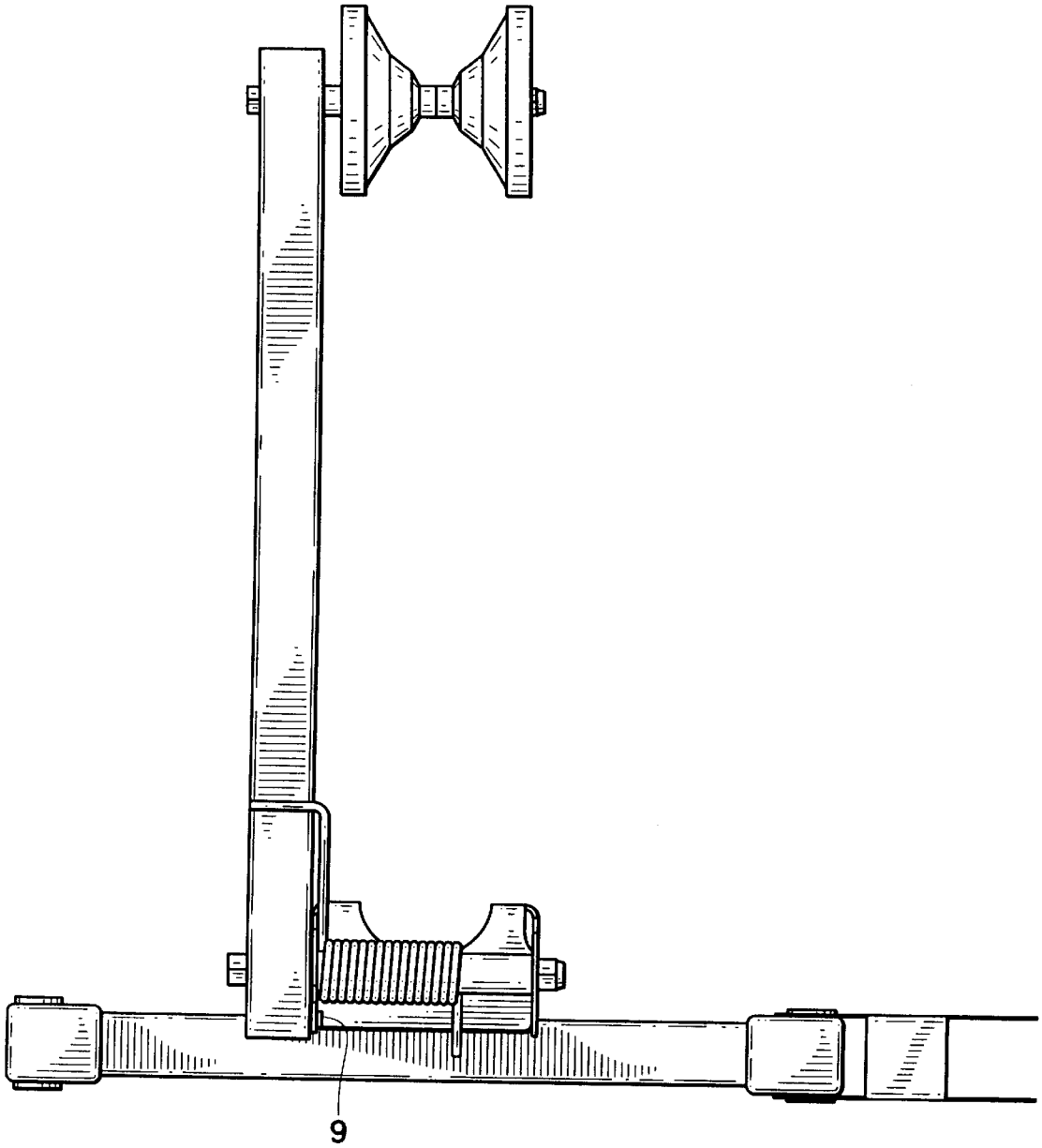
FIG. 5 is a rear elevation view of the support stand in an open position.

The preferred method of operating the support stand (3) is to first locate it in a position where a bike is to be stored or displayed. Then, if the stand is still in its compact position, the button clip button (9) should be depressed to allow the establishment of the bicycle stand in its open position. As the button clip button is depressed and an opening force is exerted against lever arm (2), the button clip button is moved from locked position (50) to open position (54). A user should depress the button clip and force lever arm (2) to its open position. After the support stand is put in its open position, a bicycle can be loaded into the stand. This is accomplished simply by rolling the bicycle onto the stand or positioning it on the first support position. For example, a bicycle rolls onto first support position (20) and pivots about that rigid support position. Because the first support is located close to the support surface, it is easy to roll the wheel onto the first support. Of course, this rigid support position could also be a rotatable support position which would accomplish exerting a normal force against the bicycle wheel while allowing the bicycle wheel to turn if there were knobs or other protrusions on the tire. As the bicycle wheel pivots about support position (20) it soon contacts third support (12). Third support (12) utilizes a rotatable support surface (13) which is capable of rotating about its pivot pin (11). As a force is exerted by the tire against support (12), the lever arm (2) yieldingly moves through an arced range of movement (60) while maintaining engagement with the tire. In this fashion, the lever arm (2) and support (12) act as a movable third support. An example of this range of movement (60) is shown in FIG. 3. This arced range of movement is limited by two retaining points, as shown in FIG. 14, as part of the retaining zone (58). The first retaining point (54) being the position of the button clip in retaining the lever arm in its open position and the second retaining point being a predefined position that can be engineered depending on the needs of the user. In FIG. 14, this second retaining point is the end of zone (58). The lever arm is permitted to move within this retaining zone.

As the bicycle wheel is rotated over the first support position (20), it soon contacts the third support (12). The force from the tire moves the third support (12) through its allowed range of motion (i.e., range of positions) until the bicycle tire encounters second support (22). At this point, the bicycle has established a support position that allows all three supports to support the tire. An actuator (10) retains the third support in substantial contact with the tire during establishment of the appropriate support position as well as when in the support position. This is accomplished in the preferred embodiment via a coil spring positioned on a retaining pin (5) coupling the lever arm (2) to the base support (4). In this manner, the lever arm forces the third support (12) against the tire; yet, the spring allows the lever arm to move in range (60) in response to the tire being pushed onto the support stand.

The lever arm moves through a generally planar area in its given range of motion. Therefore, when the tire contacts third support (12) the range of motion of the lever arm serves to guide the tire to a proper position on the second support. Therefore, the lever arm-third support combination serves not only as a support, but also as a guide for establishing the tire in a proper position on the support stand. As one of ordinary skill in the art would understand, the lever arm maintains a force against the tire and prevents the tire from moving out of position. Furthermore, the limited range of movement of the lever arm affects the range of movement of the tire.

The wheel when established in a final support position defines a planar region. This substantially planar region is defined by the circumference of the wheel. The lever arm moves through a substantially planar region to establish the wheel in the final support position. Furthermore, the substantially planar region of the wheel in its final support position and the substantially planar region through which the lever arm moves are substantially parallel.

The actuator (10) serves an important function in retaining the third support (12) against the tire before a final support position is achieved. As noted earlier, it facilitates positioning of the tire and also facilitates support of the tire. It accomplishes this by exerting a force against the tire, preventing it from tipping or twisting out of alignment.

The fact that the third support (12) engages the tire before the tire engages the second rigid support is important as the rotatable surface of third support (12) allows rough tire or wheel surfaces (e.g., knobby tires) to slide past the third support while still exerting a normal force against the tire to establish it in a proper position. If a rigid support were used for third support (12), such a rigid support would catch on the knobby tires and the second support position would not be achieved properly. Rather, the knobby tire would catch on a rigid third support as well as on the rigid first support and three point contact could not be established thereby causing the tire to be retained in an insufficient manner. The present invention prevents this by allowing the third support to at least partially rotate about its axis in response to engaging the tire and thereby achieve a three point contact position which will hold the tire in firm support.

Utilizing a movable third support with a defined range of motion allows one to establish the range of wheel sizes and shapes that can be utilized with this type of support stand. This allows the support to only work for the range of wheel radii for which it has been properly engineered. Furthermore, use of the rotatable surface accommodates these tires of varying sizes. One aspect of the guiding of the movable support lever arm (2) is the fact that such a guide prevents a tire wheel from straying. In a typical bicycle storage situation, many bicycles are located together. Therefore, the act of carelessly placing a bicycle wheel into a stand can frequently result in contact with other closely situated bicycles. A guiding feature not only prevents a bicycle wheel from hitting other bicycles, but it also prevents such a bicycle wheel from being damaged itself. Most importantly, it helps establish a proper support position. It can be easily envisioned that in support stands in the prior art that a misaligned bicycle wheel could catch its spokes, gears, or frame on a metal surface of the bicycle stand. With the present invention, the guiding feature of the third support (12) guides a wheel properly to a support position. Furthermore, this guide can intercept the upper portion of a tire or wheel out of the way of a frame or gearing mechanism. Therefore, this prevents damage to the bicycle. Similarly, as can be seen in FIG. 8, a channel structure (18) is utilized to accomplish a guiding feature for the bottom of a tire or wheel. This channel reinforces the guide accomplished by third support (12) or could also act by itself to accomplish the guiding aspect of the invention. As can be seen in FIG. 8, the guide is comprised of folded steel. Namely, the upper portion of the guide channel utilizes rolled comers to prevent damage to the side walls of the tires. These rolled corners are angled so that a misaligned tire is guided in the longitudinal direction of the channel and toward the second and third supports. By placing the edges of the channel above the first support, these edges are assured of contacting the side walls of the tire. In normal operation of the bicycle support stand, a bicycle wheel that pushes over the first support will naturally be positioned in this guide channel. Furthermore, a guide could simply be comprised of a single member raised above the first support (e.g., one side of the channel).

As can be seen in FIGS. 1 and 8, friction foot (6) can be disposed on the base support (4). These friction feet serve to establish frictional engagement with a support surface and therefore prevent the support stand from moving when forces from bicycles, pedestrians, etc., are exerted against it. These frictional feet therefore help prevent the possibility of tipping over a bicycle in the stand.

Figure 16:
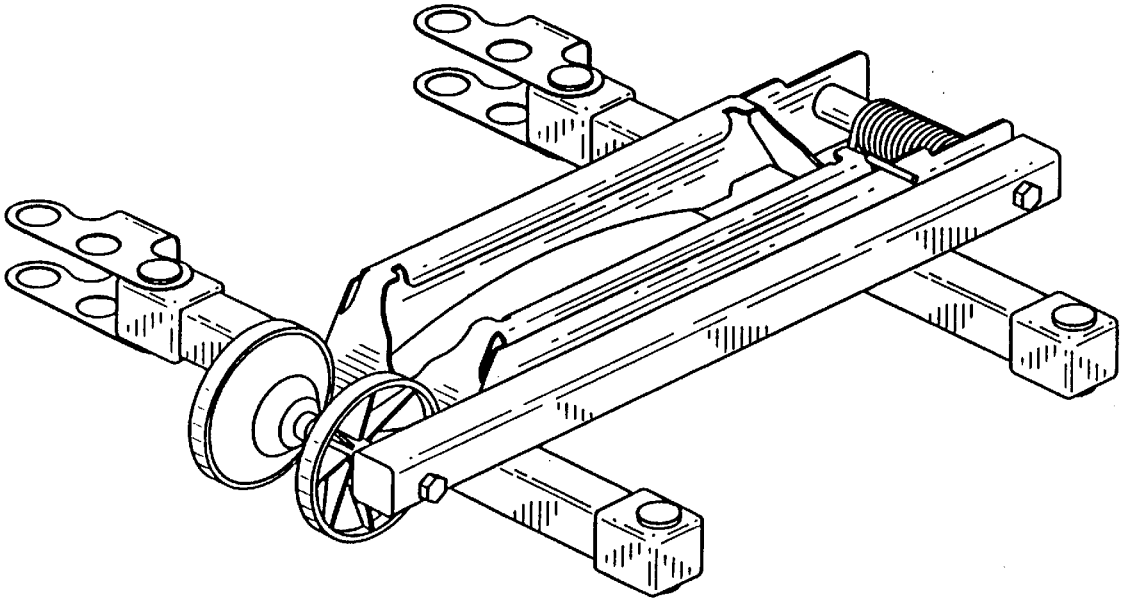
FIG. 16 shows a closed support stand in a compact position.

As noted earlier, a significant advantage of the present invention is the fact that it allows itself to be configured in a compact configuration for use in storage and transportation. Furthermore, this compaction is accomplished quickly and easily, as well as securely, by an actuator that moves the lever arm (2) from its open (or first) position to its closed (or second) position. This actuation is significant because it maintains the unit in a compact configuration as shown in FIG. 16 and it accomplishes that compaction quickly and easily without any intervention of the user other than initiating the compaction process. As can be seen in FIG. 8, a button clip (8) is disposed in lever arm (2). This button clip serves to maintain the lever arm (2) in its open position when located in open position (54). However, when the button clip button (9) is depressed, as those with ordinary skill in the art would easily understand, lever arm (2) is allowed to close toward the base support unit (4) with button clip button (9) being established in closed position (50). When latched in the open position, the second support is free to move within the zone of movement described above. This permits wheels of different radii to be supported.

Essentially, the lever arm acts as a second support coupled to base support unit (4). In the preferred embodiment, a spring (10) serves as the actuator coupled to the lever armi/second support combination to force lever arm (2) (and second support) towards its second or closed position. Upon reaching its closed position, this actuator maintains a force against the lever arm, thereby retaining the support stand in a compact configuration. This is an achievement over the prior art. Previous attempts have yielded unwieldy lever arms that were free to swing or required significant manual interaction with the support stand in order to achieve a compact configuration. The present invention is significantly easier to use as the only interaction that a user needs to provide is depression of the button clip which releases the lever arm (2) from its latched open position. Furthermore, as a second way of releasably latching the lever arm in its closed or second support position, the button clip (8) utilizes a second hole in the base support unit (4) for releasably locking lever arm (2) in its closed or second position. Therefore, not only is the lever arm retained against the base support unit by spring (10), it is also prevented from swinging open by latching of the button clip (8).

As noted earlier, a rotating support surface can be utilized in the present invention in combination with rigid supports for positioning a tire in a support stand. However, this rotary action is not limited merely to support stands, but rather can be utilized in general for the positioning of a tire, wheel, and other types of devices. As shown as part of the present invention, the rotating surface area (13) rotates about its axis when brought in contact with a tire (1). While this rotation occurs, a normal force is still exerted against a tire. Therefore, one is able to allow a tire to rotate about its axis while still maintaining a normal force against the tire. This is often useful when dealing with tires with uneven surface which must be positioned.

A significant feature of the present invention is the fact that it can be coupled to other bicycle supports to accomplish not only an attractive arrangement of bicycles for display purposes, but also to provide additional support to a neighboring stand. Furthermore, very large combinations of stands can be accomplished providing sturdy support for the entire connected system. For example, a substantially circular arrangement of bicycle stands can be accomplished.

To accomplish the coupling of a first support unit to a second support unit a link is used. This link couples the first support unit to the second support unit; however, it also allows the second support unit to rotate partially about the first support unit. This partial rotation allows the second support unit to be located at a varying position relative to the position of the first support unit. The preferred method of linking the first support unit to the second support unit utilizes retaining clip (14) as shown in FIG. 8. This retaining clip utilizes a member (16) made of high strength, low alloy steel. Furthermore, this retaining clip (14) utilizes a series of holes (15) as settings to allow a user to vary the arc of partial rotation (30) established about the coupling point on the first support unit. As can be readily understood, a user could attach the retaining clip either by the first occurring set of holes or by the middle set of holes. The third set of holes on the retaining clip would then be connected to the second support unit to establish the coupling. The partial rotation noted above can occur in a substantially planar region that is substantially parallel to the substantially planar region in which the first vehicle support sits.

By utilizing a raised area on the friction foot (6) attached to base support (4), an axis is provided over which the retaining clip can be positioned. This retaining clip (14) is a flexible device that is able to flex over raised area (7) and be seated down against the base of the raised area. Therefore, the raised area retains the retaining clip in such a fashion that the retaining clip is free to rotate about this circular raised area. When the user desires to do so, the flexibility of the retaining clip also permits the retaining clip to deflect above the raised area for removal of the clip. Therefore, the clip can be removably attached to the base support unit. Similarly, when one wishes to adjust the retaining clip to a different set of holes on the retaining clip, one need only flex the retaining clip above the raised area in order to remove it. A second raised area is used on the bottom of friction foot (6) to serve in a similar fashion. For example, a link can be removably attached over the two raised areas by positioning the holes of the link over the two raised areas and intersecting these holes with the raised areas. In this manner, the raised areas establish an axis of rotation about which the link can be partially rotated. Furthermore, this raised area on the bottom portion establishes contact with a support surface and provides a frictional foot for retaining frictional engagements with the support surface. To provide a further frictional engagement with the support surface, the raised area can be provided with a tread.

Figure 15:
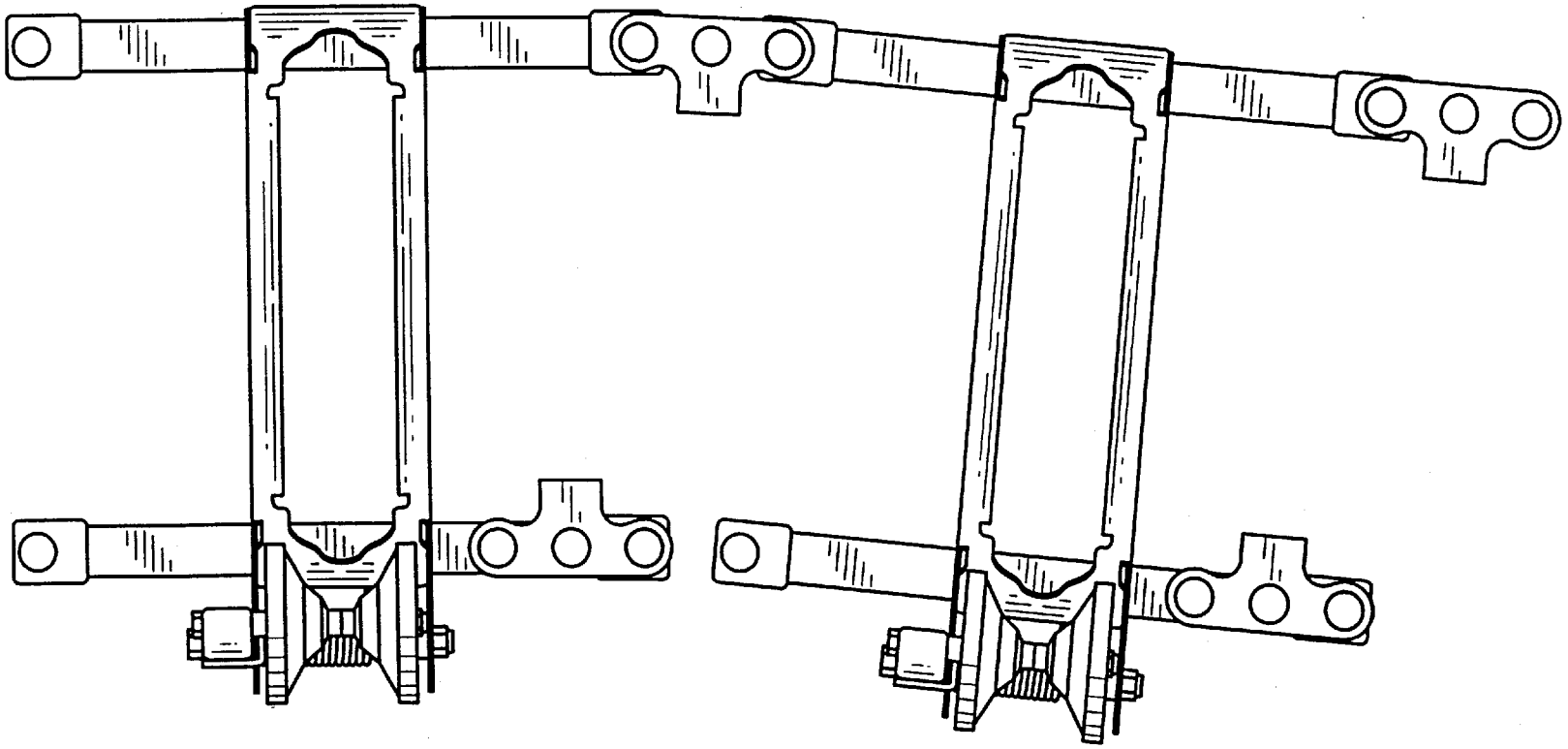
FIG. 15 shows a perspective view of two support stands ganged together with two of the three unused support clips folded against their respective base support units.

To provide a greater amount of stability to the coupling of the first and second support stands, not only can one link be used, but a second link can also be used. support that a single link may not be able to provide. However, when only one link is desired, the second link can be positioned so that it conforms to the base stand and can be folded out of the way as shown in FIG. 15. This can be appreciated viewing FIG. 1 where one is able to see that the retaining clip (4) is wide enough to swing over the leg of the base support. In this fashion, the retaining clip is retained out of the way and is prevented from being damaged either by a bicycle wheel or a bicycle rider's foot.

Figure 6:
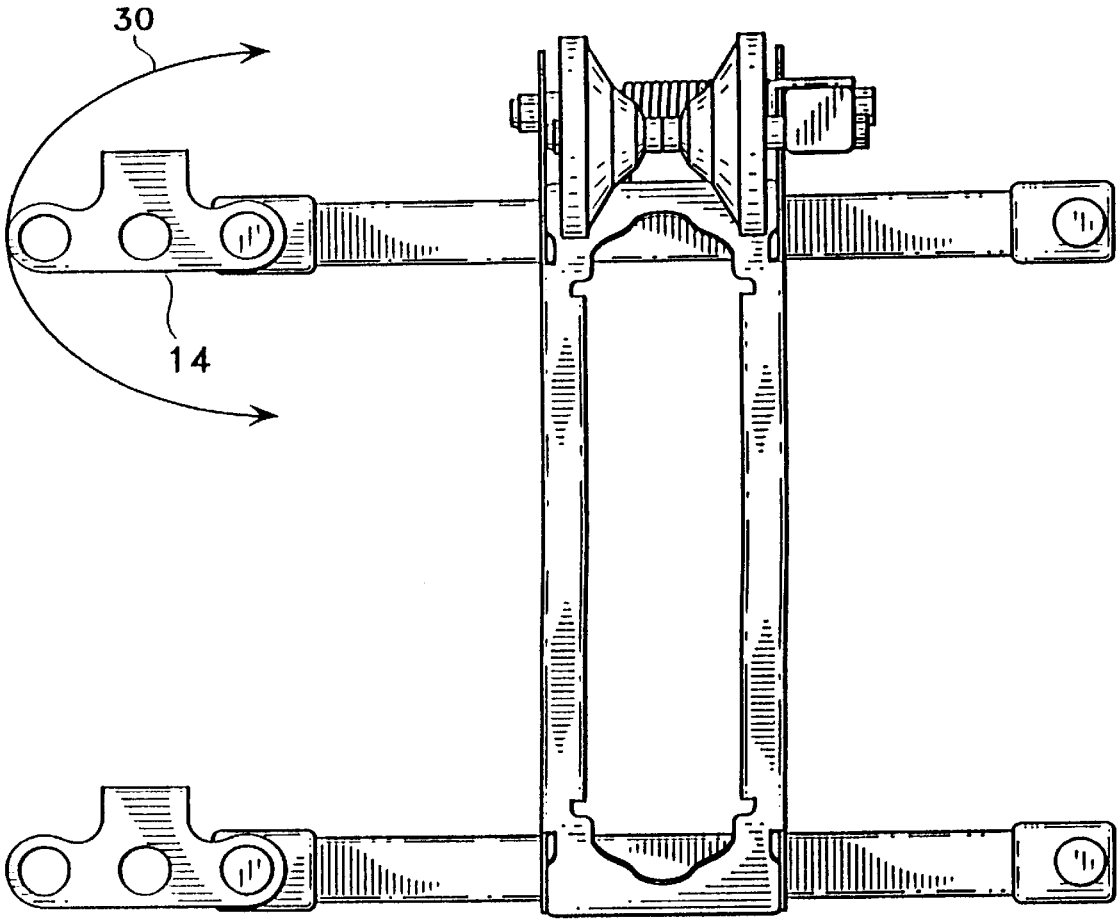
FIG. 6 is a top view of the support stand in an open position.
Figure 7:
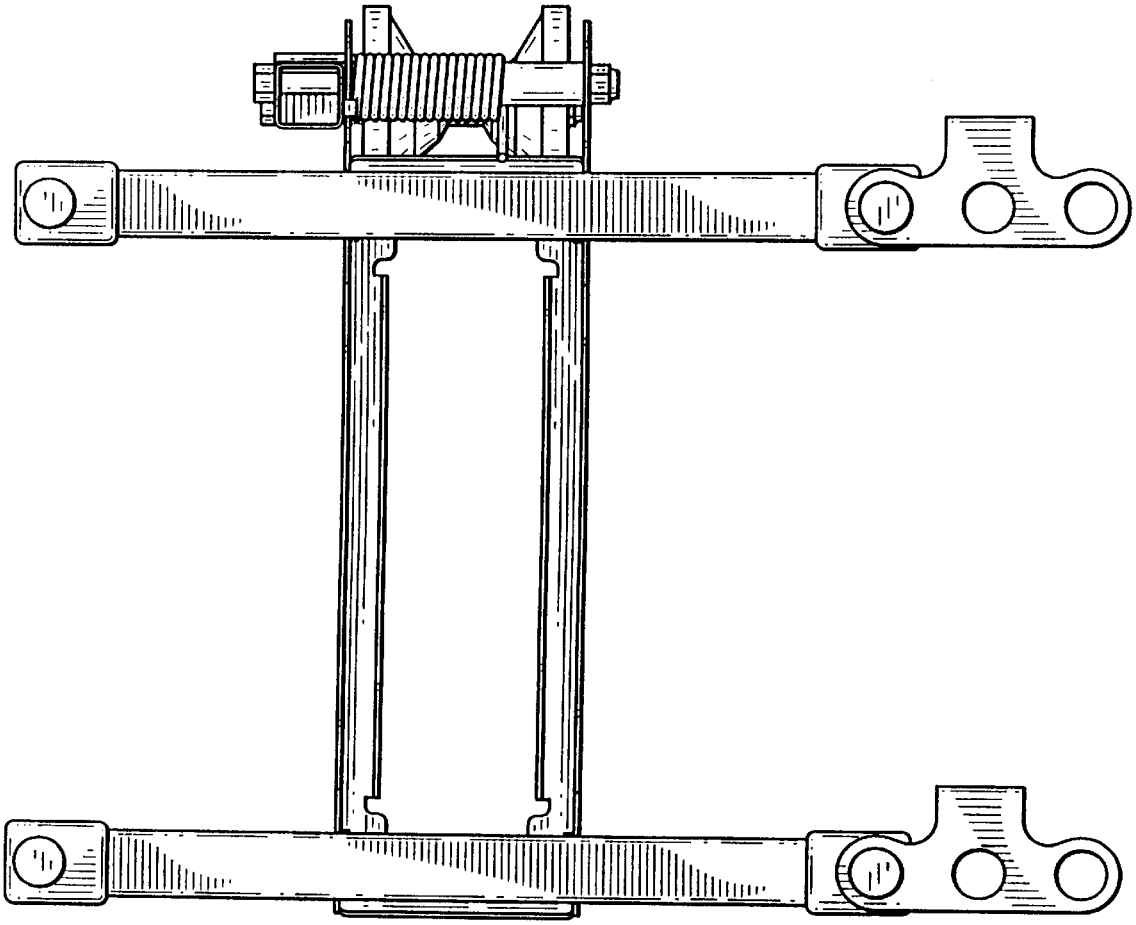
FIG. 7 is a bottom elevation view of the support stand in an open position.

As can be seen in FIG. 6, the link (14) is capable of rotating through an arced range of positions. This allows the second support unit to be positioned in a corresponding arcuate region. While in the preferred embodiment, this arc is defined by a straight-link rotated about a fixed axis, it is conceivable to utilize other couplings that would provide varying positions of support about a first support unit but not necessarily in a purely semi-circular region. Furthermore, it is conceivable to use links of different lengths and with additional points of connection for varying further the range of position within which a support unit could be positioned with respect to a first support unit.

The foregoing discussion and the claims which follow describe the preferred embodiments of the present invention. Particularly with respect to the claims it should be understood that changes may be made without departing from the essence of this invention. In this regard, it is intended that such changes would still fall within the scope of the present invention. It is simply not practical to describe and claim all possible revisions which may be accomplished. To the extent such revisions utilize the essence of the present invention, each naturally falls within the breadth of protection encompassed by this patent. This is particularly true for the present invention since its basic concepts and understandings are fundamental in nature and can be applied broadly in a variety of ways. Further, it should be understood that various permutations and combinations of the elements shown in the claims are possible and should fall within the scope of this disclosure. Finally, it should be understood that the invention is not limited merely to bicycles nor to bicycle stands for use in a retail store. It is envisioned that the basic concept of the invention could apply to other vehicles and could apply to vehicle stands used in the home, on the tops of automobiles, in front of school buildings, or any other setting where a tire support stand is required. Furthermore, while discussion of the invention has referred to both tires, wheels and vehicles, it should be understood that the invention could be utilized for a wide variety of generally circular articles.

What is claimed is:

1. A device for supporting a plurality of vehicles, said device comprising:

a) a first support unit for supporting a wheel of a first vehicle;

b) a second support unit for supporting a wheel of a second vehicle;

c) a link for coupling said first support unit to said second support unit, said coupling permitting partial rotation of said second support unit about said first support unit wherein said link defines an arcuate region for positioning of said second support unit relative to said first support unit.

2. A device for supporting a plurality of vehicles as described in claim 1, said device further comprising a second link for coupling said first support unit to said second support unit.

3. A device for supporting a plurality of vehicles as described in claim 1 wherein said first support unit comprises a first raised area, wherein said link is coupled to said first raised area.

4. A device for supporting a plurality of vehicles as described in claim 3, further comprising a second raised area on said first support unit, wherein said link is coupled to said second raised area.

5. A device for supporting a plurality of vehicles as described in claim 3, wherein said first raised area engages a support surface.

6. A device for supporting a plurality of vehicles as described in claim 5 wherein said first raised area frictionally engages a support surface.

7. A device for supporting a plurality of vehicles as described in claim 1 wherein said link comprises a member.

8. A device for supporting a plurality of vehicles as described in claim 7 wherein said member comprises high strength low alloy steel.

9. A device for supporting a plurality of vehicles as described in claim 1 wherein said link comprises a plurality of positions for coupling to said first support unit.

10. A device for supporting a plurality of vehicles as described in claim 9 wherein said link comprises a hole for engaging said first support unit.

11. A device for supporting a plurality of vehicles, said device comprising:

a) a first support unit for supporting a wheel of a first vehicle;

b) a second support unit for supporting a wheel of a second vehicle;

c) a link for coupling said first support unit to said second support unit, said coupling permitting partial rotation of said second support unit about said first support unit wherein said link is capable of folding onto said first support unit when not in use.

* * * * *